United States Patent [19]

Cutter

[11] 4,008,501

[45] Feb. 22, 1977

[54] ELECTRICALLY ACTUATED PUNCHING AND BINDING APPARATUS

[75] Inventor: James W. Cutter, Los Altos, Calif.

[73] Assignee: NSC International Corporation, Hot Springs, Ark.

[22] Filed: Mar. 12, 1976

[21] Appl. No.: 666,339

[52] U.S. Cl. ..... 11/1 AC; 83/549

[51] Int. Cl.[2] ..... B42C 19/00; B26D 5/08

[58] Field of Search ..... 11/1 AC, 1 A; 83/549

[56] References Cited

UNITED STATES PATENTS

| | | | |
|---|---|---|---|
| 3,475,775 | 11/1969 | Staats | 11/1 AC |
| 3,761,983 | 10/1973 | Staats | 11/1 AC |
| 3,967,336 | 7/1976 | Cutter | 11/1 AC |

*Primary Examiner*—Lawrence Charles

*Attorney, Agent, or Firm*—Boone, Schatzel, Hamrick & Knudsen

[57] ABSTRACT

A combination punching and binding machine for gang punching a stack of sheets and binding the sheets with a pre-curled plastic comb-binding element. The machine is electrically operated by energizing a reversible motor which, when operated in one mode actuates the punches, and when operated in a second mode, laterally moves a comb upon which the binding element is placed and then actuates a plurality of hook elements to uncurl the curled splines of the binding element for receiving the punched sheets.

14 Claims, 11 Drawing Figures

ELECTRICALLY ACTUATED PUNCHING AND BINDING APPARATUS

The present invention is an improvement upon the apparatus disclosed in my co-pending U.S. patent application, Ser. No. 567,622, filed Apr. 14, 1975, now U.S. Pat. No. 3,967,336.

BACKGROUND OF THE INVENTION

1. Field of the Invention

The present invention relates generally to document binding apparatus, and more particularly, to an electrically operated combination punching and binding machine for punching sheets and then binding the sheets with a plastic comb binder.

2. Description of the Prior Art

Heretofore, numerous devices have been provided for facilitating the binding of documents and the like with a flexible binding known as a "comb-binder." The prior art devices usually include means for punching a plurality of holes along an edge of the documents to be bound, and means for aiding in the insertion of the binder comb teeth through the holes. Examples of such devices are disclosed in the above-identified pending application and in the U.S. Pat. Nos. to Lyon, 3,669,596; Bouvier, 3,227,023; Bouvier, 3,122,761; and Stuckens, 3,060,780.

Although these prior art binding devices clearly accomplish the intended result in an acceptable fashion, they are manually operated and suffer from disadvantages associated with undue mechanical complexity requiring a relatively large number of machined parts. Moreover, none of the prior art machines incorporate a fully electrically-operated punching and binding mechanism.

SUMMARY OF THE PRESENT INVENTION

It is therefore a principal object of the present invention to provide an electrically-operated punching and binding device having simple mechanical components not requiring close machine tolerances.

Briefly, the preferred embodiment of the subject binding device includes an improved binder-inserting mechanism and an improved punching mechanism both of which are driven by a single electrical motor. The binder inserting mechanism includes a pair of actuating arms affixed to a main shaft that is driven by the electric motor, a first laterally-moving cam which is driven by one of the actuating arms and which in turn moves the binder-holding comb laterally, and a second laterally-moving cam which is driven by the other actuating arm and which, through a linkage mechanism, moves the binder-spreading hook plate away from the holding comb. The punching mechanism is driven by the shaft through a simplified rack-and-pinion structure.

An important advantage of the present invention is that the device is mechanically simpler than prior art devices.

Another advantage of the present invention is that the major punching and binding components are interchangeable with similar manually-operated apparatus.

A further advantage of the present invention lies in its simplicity of operation.

A still further advantage of the present invention is that it has a high degree of reliability.

Another advantage of the present invention is that when the machine is operated in the punching mode, the hooks and comb are motionless.

Another advantage is that the amount of movement of the hooks can be preset by the operator for repetitive opening for making books of the same size.

Another advantage is that the operator can override with fingertip control a preset opening of the hooks and can control the hook movement forward and back with fingertip electrical controls.

Another advantage is that if the punches should become jammed, the operator can back them out of the jammed position by reversing the motor.

Other objects and advantages of the present invention will no doubt become apparent to those of ordinary skill in the art after having read the following detailed description of the preferred embodiment which is illustrated in the several figures of the drawing.

IN THE DRAWING

Figure 6:
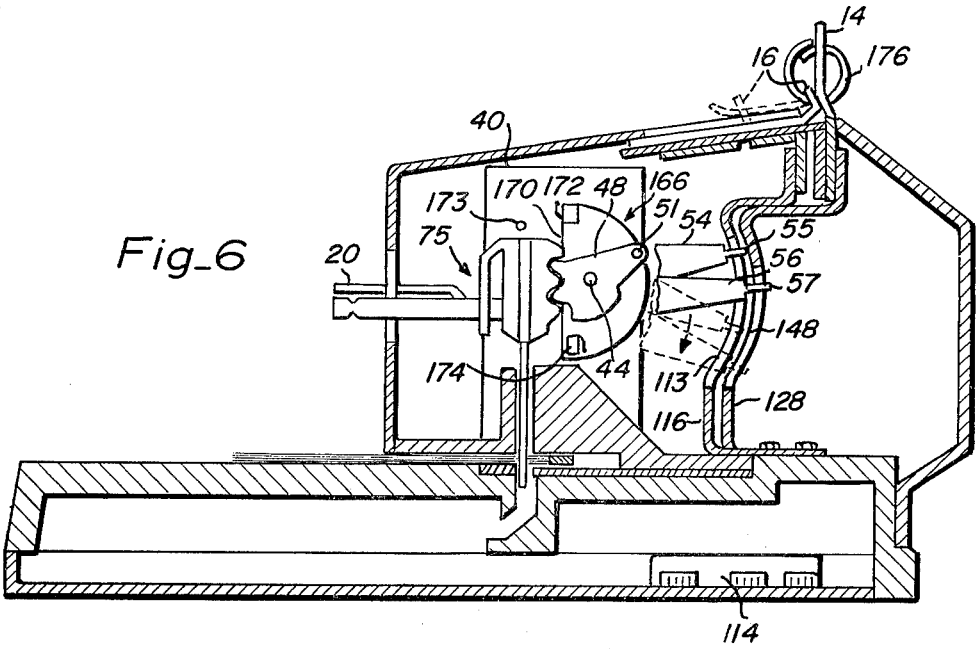
FIG. 6 is a sectional view taken along the line 6—6 of FIG. 1.
Figure 6A:
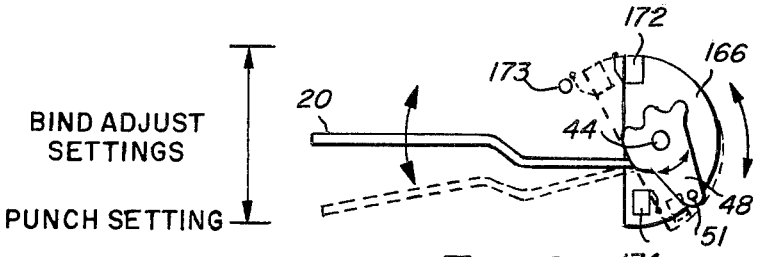
Figure 7:
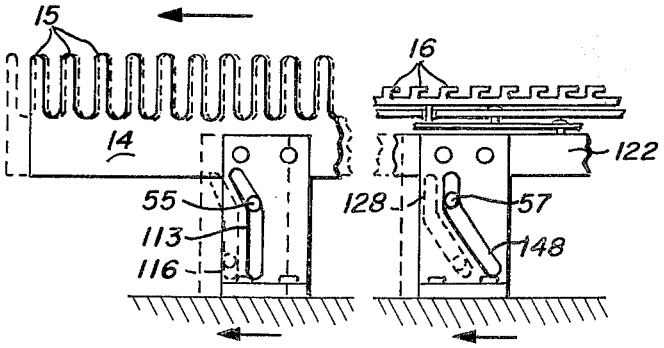
Figure 8:
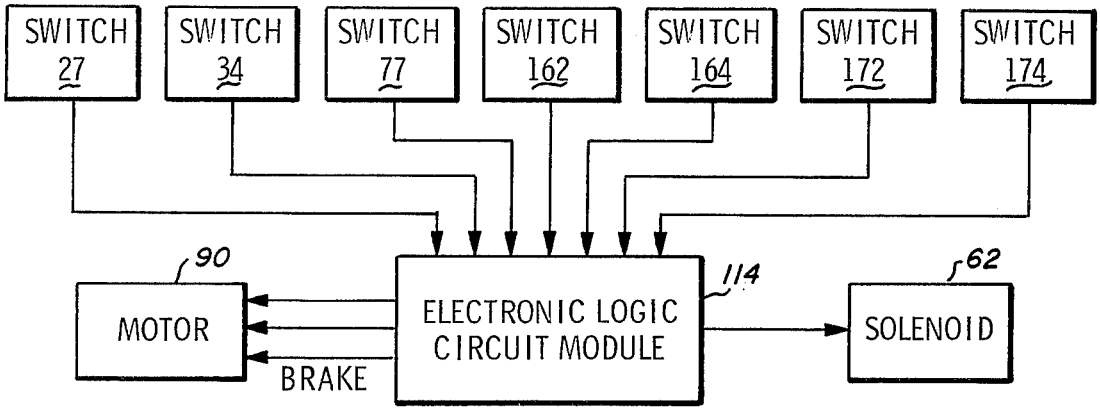
Figure 10:
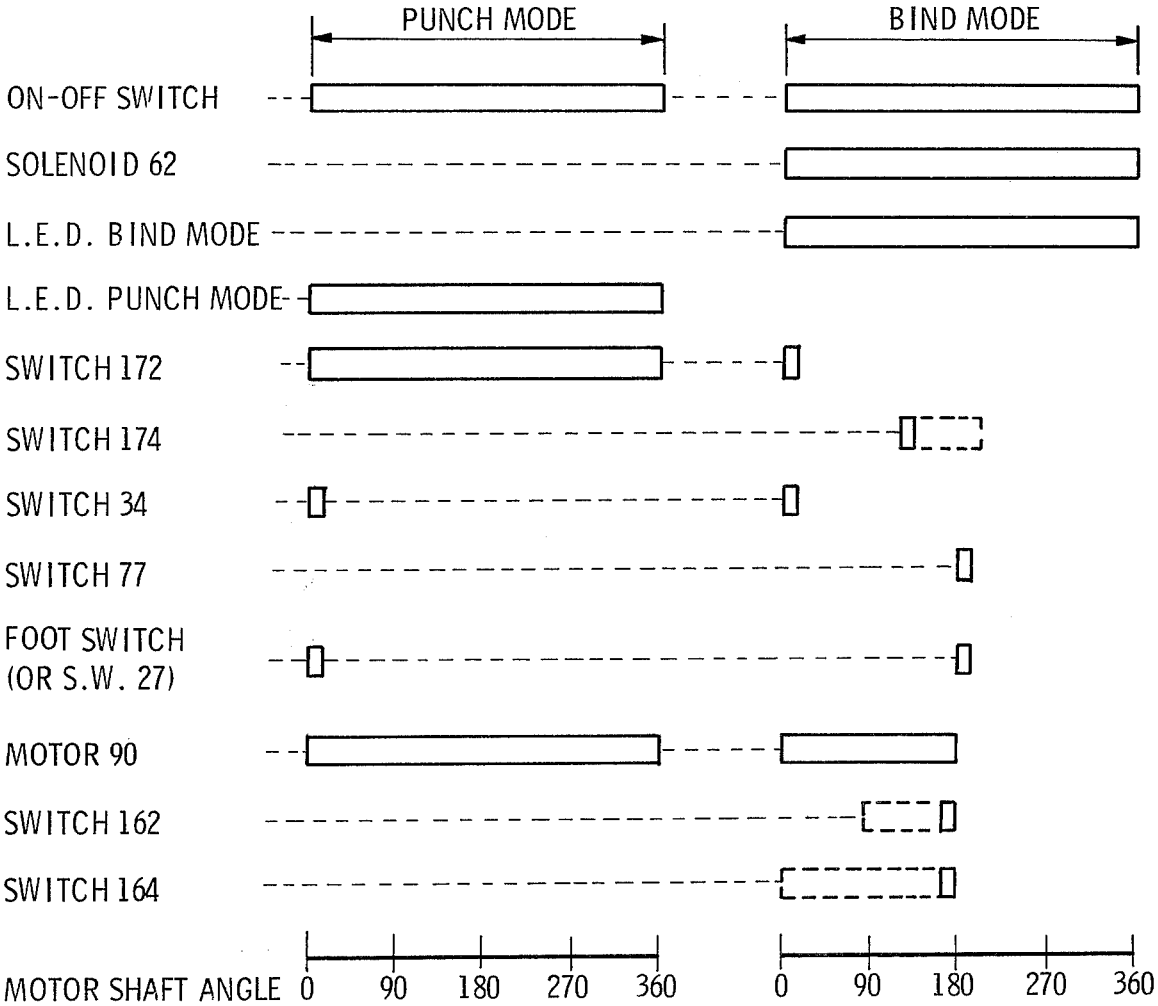
Figure 9:
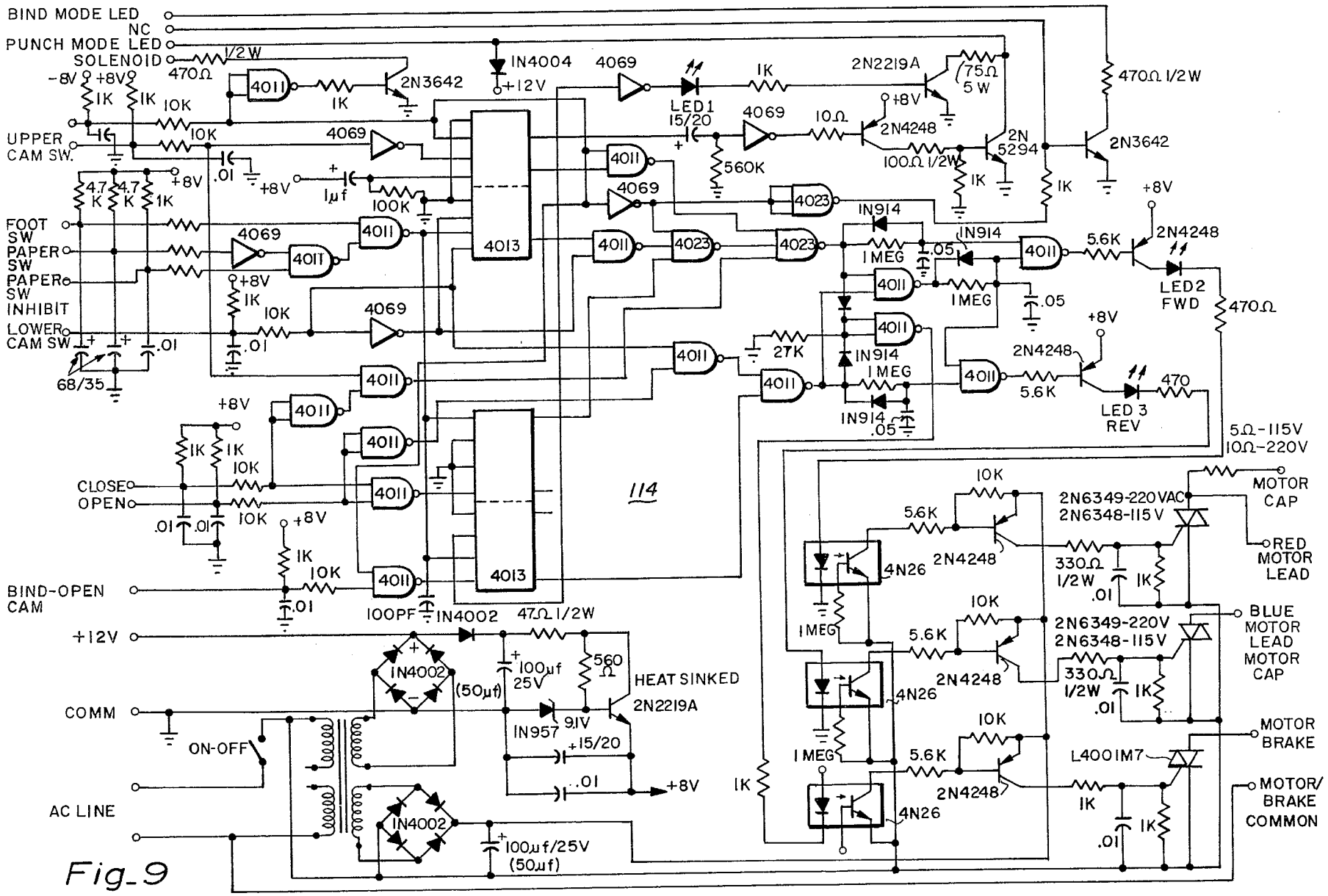

FIG. 6A more clearly illustrates operation of the punch/bind control selector shown in FIG. 6;

FIG. 7 is a fragmentary view showing the relative movement of the comb and hooks with respect to the movement of the cams;

FIG. 8 is a block diagram depicting the electrical control circuit of the present invention;

FIG. 9 is a schematic diagram illustrating the electronic control module of FIG. 8; and FIG. 10 is a timing diagram showing the relationship between various switches as the invention is operated in the punching or binding mode.

DETAILED DESCRIPTION OF THE PREFERRED EMBODIMENT

Figure 1:
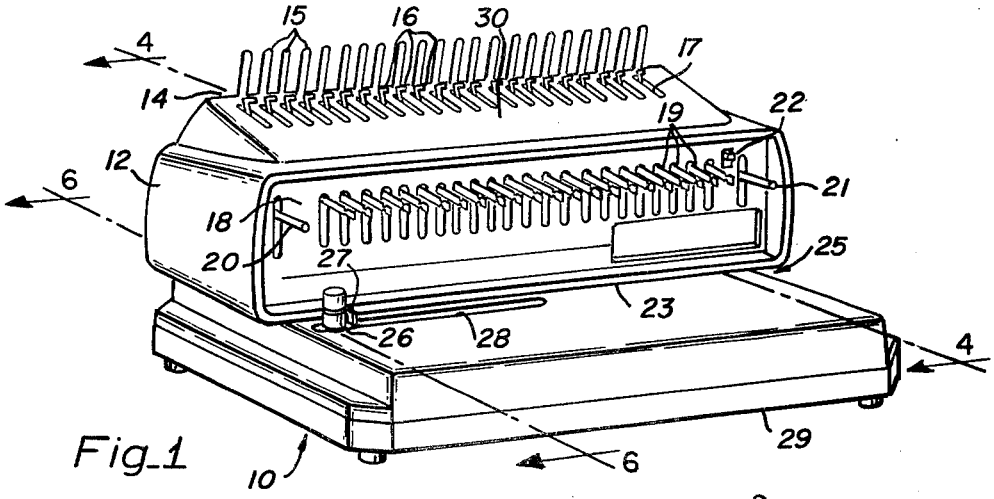
FIG. 1 is a perspective view of a punching and binding machine in accordance with the present invention.

Referring now to FIG. 1 of the drawing, a punching and binding machine in accordance with the present invention is shown to include generally a two-part base 10 and an upper housing 12 having a plurality of levers and operative components extending therefrom. More particularly, projecting from the upper surface of housing 12 is a comb 14 including a plurality of hooks 16 extending through slots 17 in top plate 30. An apertured face plate 18 is affixed to the front side of housing 12 and has a plurality of punch selector pins 19 extending therethrough along with a binder adjustment lever 20, a margin adjustment lever 21 and an on/off switch 22. Plate 18 may also include small apertures or windows (not shown) behind which are mounted mode indicating lights or LEDs.

The lower edge 23 of the front of housing 12 is spaced from the upper surface of base 10 to provide a paper receiving slot 25. The exposed upper surface of base 10 is plane and flat with the exception that a side guide adjustment knob 26, having an optional safety lockout switch 27, is provided in a slot 28 extending across the upper surface of base 10 parallel to the front edge of housing 12. At the bottom of base 10 a chip tray 29 is provided as will be further described below.

In operation, switch 22 is switched to the "on" position. Lever 20 is moved to the "punch mode" position (to enable the punch control circuitry) and a stack of paper or other sheet material is placed upon the top surface of base 10 and one edge is inserted in slot 25, with another edge positioned proximate guide 26. Switch 27 is then contacted by sliding the sheets leftwardly. Or alternatively, a foot treadle switch is depressed (not shown) which energizes an electric motor (described in more detail later) causing punches contained within housing 12 to first be driven through the sheets and then be extracted from the sheets and returned to their normal position. The sheets are then removed from the front of the machine and a plastic comb binder is placed over the teeth of comb 14 with the backbone of the binder positioned to the rear of the comb.

The binder adjustment lever 20 is adjusted to a position in the "binding mode" corresponding with the particular size (or diameter) binder used. This enables the binder control circuitry. The foot treadle (or alternatively, switch 27) is actuated causing the comb 14 to move laterally, engaging the fingers of the comb binder with hooks 16 which then sequentially after the lateral comb movement extend the binder fingers in a straightening manner. Next, the stack of punched sheets is placed over the extended binding fingers with the finger-tips in registration with the punched holds. A binder retractor switch 162, also on the back of housing 12, is then depressed, causing hooks 16 to retract and allow the binding fingers to curl upwardly and thereby extend through the punched holes. At the end of the hooks 16 movement, the comb 14 returns laterally to its original position completing the binding cycle. The resilient fingers of the binder will have extended themselves through the punches holes and returned to their normal curled position, and the now bound stack of papers can be lifted from comb 14.

Figure 2:
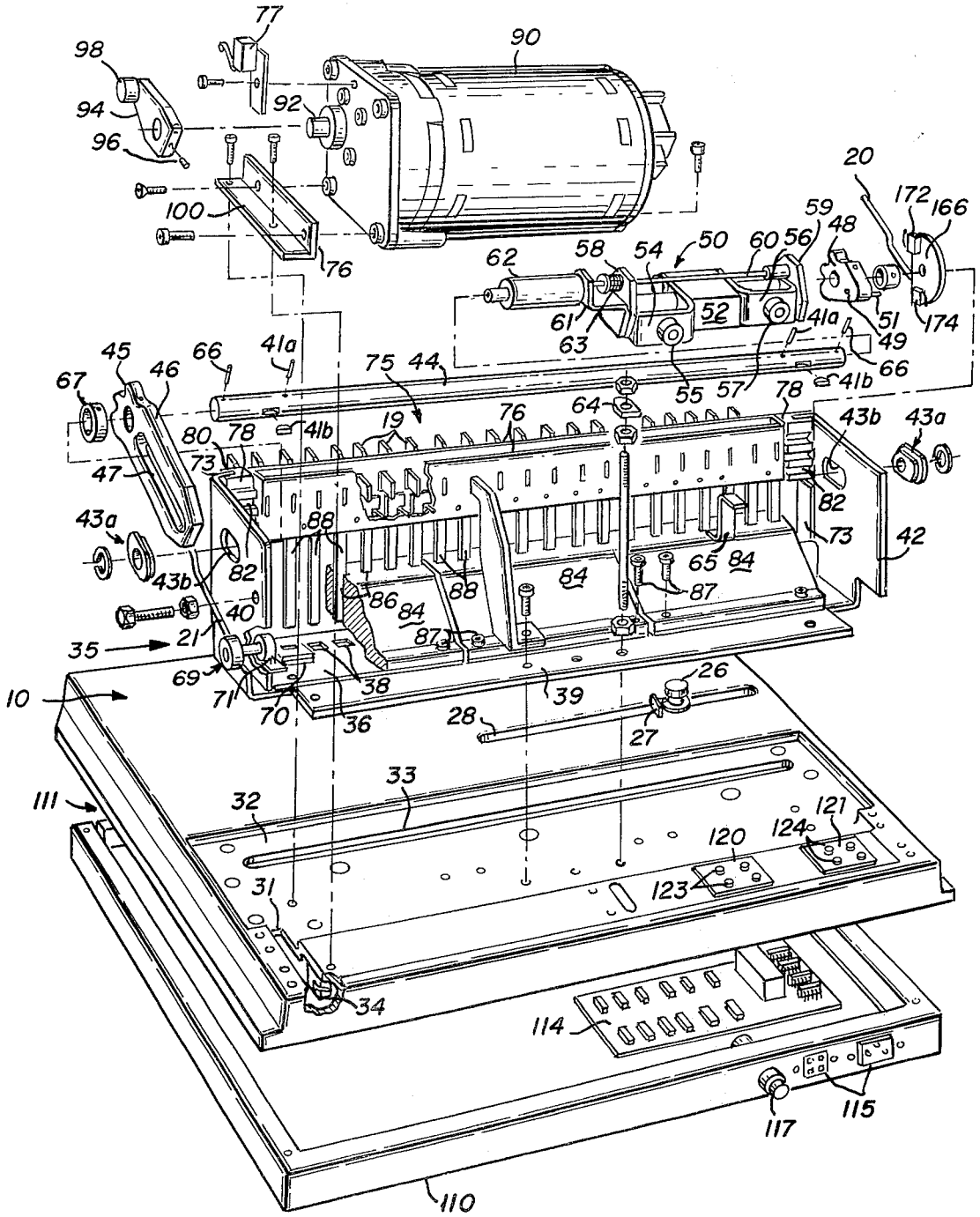
FIG. 2 is an exploded partially broken rear view showing the internal components of the machine illustrated in FIG. 1.
Figure 3:
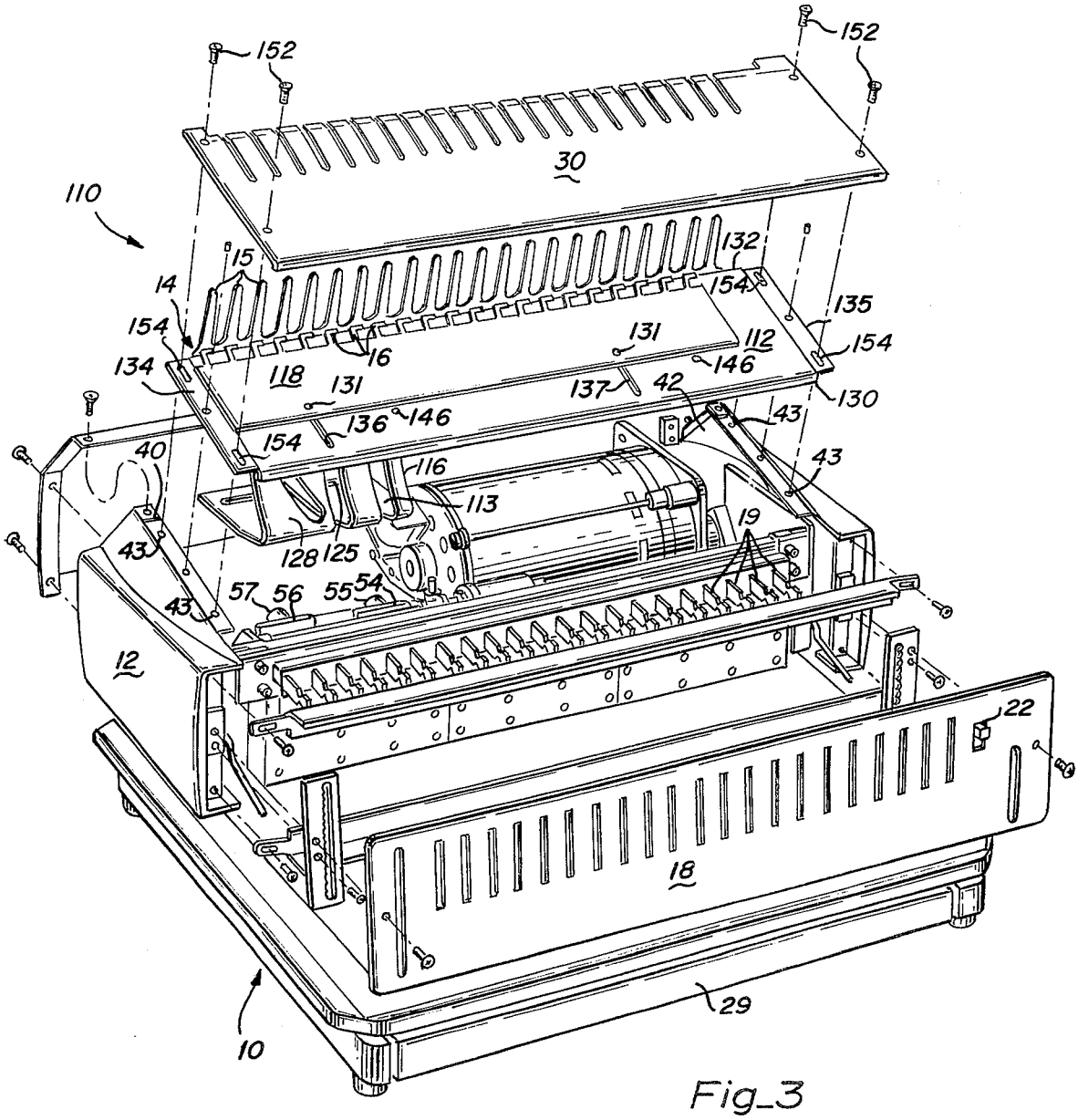
FIG. 3 is an exploded front view showing the internal components of the machine illustrated in FIG. 1.

To now describe the working components of the preferred embodiment, reference is made to FIGS. 2 and 3 of the drawing which are exploded, partially broken rear and front views, respectively, of the base 10 and the operative mechanisms normally disposed within the interior of housing 12. As illustrated, in addition to the side guide adjustment knob 26, switch 27, and slot 28, the upper surface of base 10 is provided with a recessed portion 32, an elongated slot 33 which extends laterally across the recessed portion, and a microswitch 34 which for convenience is disposed beneath the top surface of base 10 and beside the lever clearance opening 31. Slot 33 provides a discharge passage for punched paper chips and microswitch 34 actuates logic circuitry to deenergize the punch and binding drive motor after the punch cycle has been completed. The portion of base 10 covered by housing 12 also includes numerous apertures for receiving various fasteners, screws, bolts, etc.

Positioned above base 10 is a punching assembly 35 including die plates 36 having a plurality of female die apertures 38 formed near the forward edge thereof, a chassis 39 including a pair of end supports 40 and 42, and an actuating shaft 44 shown exploded but which is actually journaled at its respective ends to supports 40 and 42 by suitable bearing assemblies 43*a*.

Mounted to shaft 44 at one end is an actuating lever 46 having a rack engaging pinion gear 45 at one extremity and a slot 47 extending along the opposite extremity for mating with a driving eccentric. Mounted to the other end of shaft 44 is an eccentric 48 having pinion gears on one side and a hole 49 for mating with a solenoid actuated locking pin 60. The three-tooth gears and racks assure positive withdrawal of the punches from the punched paper. Prior art devices must rely for about the last one-eighth inch of upward travel of the pressure bar to be controlled by springs. This means that when the punches are withdrawing from paper or from very obtuse plastic such as acetate, they may stick and not come up the last amount of travel. Yet there is no power that can be applied because of the free wheeling drive feature. However, in the present invention there is now 100 percent positive control of the punches over their entire travel.

Also mounted to shaft 44 next to eccentric 48 is a binding drive assembly 50 that includes a pair of camming arms 54 and 56 which are affixed to opposite sides of a spacer bracket 52. Although not clearly shown in this figure the block 52 and arms 54 and 56 all include apertures through which shaft 44 is passed. Arms 54 and 56 each include frictionless camming buttons 55 and 57, the purpose of which will be described below. Affixed to the opposite sides of arms 54 and 56 are a pair of end plates 58 and 59 having apertures therein through which the locking pin 60 is passed. Plate 58 also has a bracket 61 attached to it for supporting a solenoid 62 which drives the locking pin 60. A spring 63 is fitted over the end of rod 60 for withdrawing the tip thereof from mating engagement with aperture 49. Once the shaft 44 is inserted through the apertures in assembly 50, lever 46 and pinion 48 the ends of the shaft may be mounted to the end supports 40 and 42 by slipping the ends through the openings 43*b* and the bearing assemblies 43*a*. The lever 46 and eccentric 48 are then keyed to shaft 44 by keys 41*b* and locked in place by pins 41*a*. The shaft itself is secured in place by a pair of collars 67 which are locked to the shaft by pins 66. Also mounted on shaft 44 is a binder size adjustment mechanism 166 which is described below.

In order to bias the assembly 50 into a rest position with the bracket 61 bearing against a stop 46, a leaf spring 65 is provided which partly circles shaft 44 and has one end attached to one of the three punch guide blocks 84 by a suitable screw fastener. The other end is slipped under spacer bracket 52 to bias assembly 50 in the indicated direction. Also attached to end support 40 is a punch margin setting assembly 69 which includes a margin bar 70, a linkage mechanism 71 and the margin adjust lever 21 which is shown in FIG. 1. This assembly is more clearly shown in my co-pending application referred to above.

As may be noted from the drawing, the forward edges of end supports 40 and 42 are turned inwardly as shown at 73 and form guide rails for guiding the vertical motion of a pressure bar assembly 75 which includes a pair of separated plates 76 joined at their ends. Plates 76 are also affixed to end fittings 78 which have vertical grooves 80 in their side faces for mating with the support edges 73 and rack gears 82 formed in their rear face for mating with the pinion gears of lever 46 and eccentric 48. The punch selector pins 19 pass through openings in the plates 76 as indicated.

Disposed immediately beneath the assembly 75 are three punch guide blocks 84 having guide ways 86 for receiving the punches 88. The blocks 84 are positioned on top of the die plates 36 with their punch passages 86 aligned with the die apertures 37, and are secured to the chassis by means of bolts 87.

Shown above the guide assembly 75 but actually mounted to the chassis at the rear of the apparatus is a motor 90 having a geared drive shaft 92 to which is affixed an eccentric 94. Motor 90 is mounted to the base 10 by means of a bracket 100 which is bolted to both motor 90 and base 10. Motor 90 is a reversible direction device which also includes an electric brake for holding the armature in the position at which it is stopped. Eccentric 94 is secured to shaft 92 by a lock screw 96 and has a frictionless roller 98 mounted to its eccentric end. The roller 98 fits within the slot 47 of lever 46 and serves to rotate shaft 44 to either drive the punches 88 or to actuate the binding assembly 50.

In the preferred embodiment, the base 10 includes a sub-base assembly 110 which has a chip receptacle 111 provided in the front portion and an electronics containing chamber in the rear portion. The electronics module 114 is disposed in the rear chamber and is coupled to the various microswitches included in the apparatus. These switches serve to energize motor 90 at appropriate times and in appropriate rotary directions to achieve the elected operation. Sub-base 110 also includes electrical plug outlets 115 for a line cord and the alternative foot treadle switch, and a fuse fixture 117.

Figure 5:
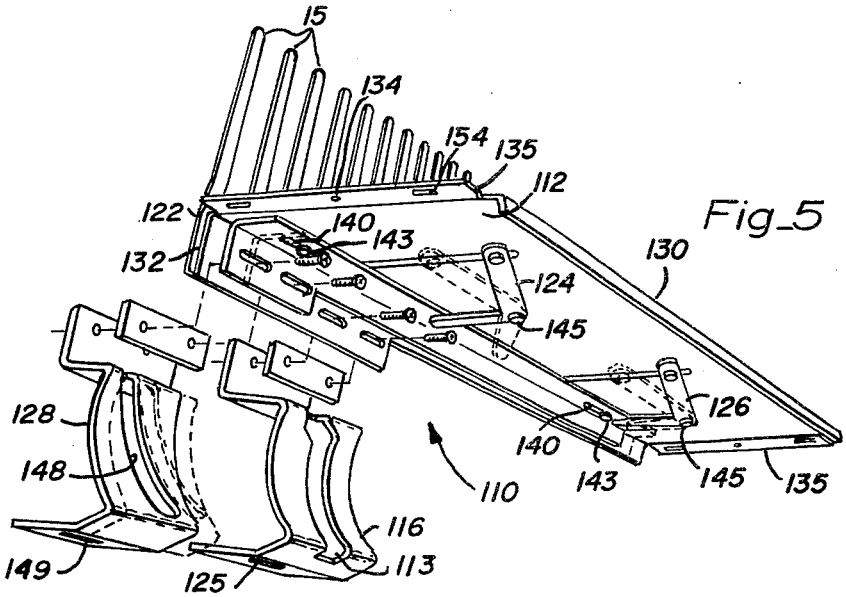
FIG. 5 is an inverted perspective view showing the relative positioning of the comb assembly, bell crank assembly, and cams of the comb and bell crank assemblies, respectively.

The binding assembly shown exploded at 110 in FIGS. 3 and 5 includes the top plate 30, an alignment plate 112, a comb plate 14 and a driving cam 116, a hook plate 118 and a driving cam 128. At the rear of the top surface of base 10 are pads 120 and 121 having outstanding stubs 123 and 124, respectively, for mating with the binding cams as will be discussed in detail below. Alignment plate 112 includes downturned front and rear edges 130 and 132, respectively, and laterally extending apertured mounting flanges 134 and 135. Plate 112 is provided with two front-to-rear extending guide slots 136 and 137. Comb plate 14 includes a flat base portion (not shown) and vertically-extending fingers 15. Cam 116 is comprised of a rigid metal bar having its mid-portion arcuately bowed to be concentric with shaft 44 (see FIG. 5), its upper end deformed vertically for affixment to comb plate 14 with suitable bolts or spot welds, and its lower end deformed horizontally to slideably engage the top surface of base 10.

Cam 116 is provided with a camming slot 113 which is configured as illustrated for receiving the button 55 of camming arm 54. As will be discussed in more detail below, the angled portion of slot 113 causes cam 116 to drive comb plate 14 laterally as shaft 44 is rotated. A slot 125 receives alignment stubs 123 on base 10.

Hook plate 118 includes a plurality of slightly upturned hooks 16. The number and location of hooks 16 are chosen to be complementary with the number and location of teeth 15 on comb plate 14. Hook plate 118 is slideably mounted upon the upper surface of alignment plate 112 by bolts or rivets 131 which extend through slots 136 and 137 in plate 112.

As is perhaps most clearly shown in FIG. 5 of the drawing, a drive bar 122 is slideably mounted to the lower surface of alignment plate 112 by bolts or rivets 143 which pass through apertures (not shown) in plate 112 and through slots 140 in bar 122. The elbows of cranks 124 and 126 are pivotally attached to the bottom surface of plate 112 by suitable pivot bolts or rivets 145 which extend through holes 146 (FIG. 3) in plate 112.

Cam 128 is comprised of a rigid bar having its mid-portion arcuately bowed to be concentric with shaft 44 and its lower end deformed horizontally to slideably engage the top surface of base 10. Cam 128 is provided with a camming slot 148 which is configured as illustrated for receiving the button 57 of camming arm 56. The angled portion of slot 148 causes cam 128 to drive bar 122 laterally as shaft 44 is rotated. A slot 149 receives alignment stubs 123 on base 10.

Once the binding assembly 110 is fabricated, it and top plate 30 are mounted to end supports 40, 42 (FIG. 3) by screws 152 which are passed through holes 154 in alignment plate flanges 134 and 135, and threaded into threaded bores 43 of end supports 40 and 42. Exterior housing 12 (FIG. 1) is positioned around the punching and binding assemblies and secured by suitable means.

Figure 4:
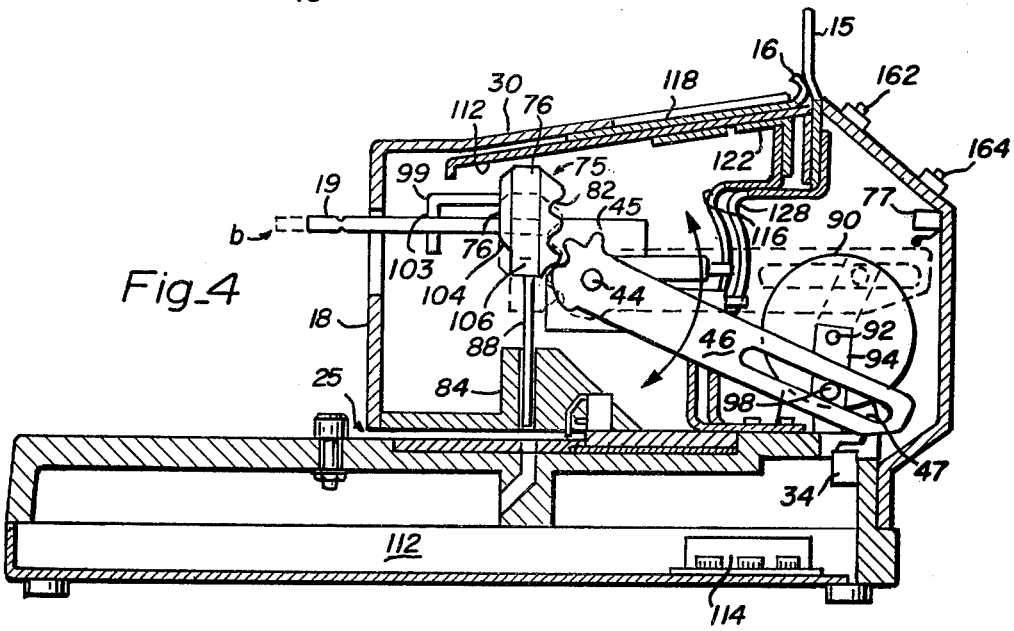
FIG. 4 is a partial sectional view taken along the line 4—4 of FIG. 1.

FIG. 4 is a partial cross-sectional view taken along the line 4—4 of FIG. 1 showing the interrelationship between the various punching components. As is shown, with eccentric 94 in its lowermost position, the last gear tooth of gear 45 contacts the lowermost nub of rack gear 82, thereby holding the pressure bar assembly 75 in the raised position shown. As motor 90 rotates eccentric 94, pinion gears 45 mesh with rack gears 82, forcing the punch assembly 75 downwardly. With punch selector pins 19 in the fully inward position, the lowering of assembly 75 causes pins 19 to engage the tops of punches 88 and force them downwardly through punch guides 84 and into contact with the sheets of paper lying therebetween in slot 25. As punches 88 force their way through dies 38, holes of predetermined size are formed in the sheets with the chips falling into chip receptacle 112. As motor 90 rotates eccentric 94 further, pinion gears 45 drive rack gears 82 and assembly 75 upwardly. The lower edges of heads of punches 88 are engaged by straps 106, thereby causing punches 88 to be withdrawn from dies 38 and the sheets previously punched.

FIG. 4 also illustrates the interrelationship between punch selector pins 19, pressure bar assembly 75 and punches 88. As is shown, the heads of punches 88 pass between the plates 76, while selector pins 19 pass through apertures 103 in bracket 99 and 104 bars 76, passing directly over each one of the punches 88. Selector pins 19 may be selectively pulled forward into the position illustrated by dashed lines *b* so as not to contact the top of punch 88 when pressure bar assembly 75 is forced downwardly during the punching operation. In this manner, certain punches may be omitted to provide a desired punch pattern.

Also shown in FIG. 4 are a binder retractor switch 162, and binder extender switch 164 and an electronic logic circuit 114. Switches 162 and 164 are for energizing motor 90 so as to rotate eccentric 94 in the counterclockwise or clockwise direction, respectively. These switches are used in the binding operation and will be discussed in more detail below, as will circuit 114 which provides control signals for motor 90 and solenoid 62.

FIG. 6 is a partial cross-sectional view taken along the line 6—6 of FIG. 1 showing the operation of the binding mechanism. As shown, with eccentric 48 in the upright position, the frictionless buttons 55 and 57 are positioned within the top of slots 113 and 148 of cams 116 and 128, respectively.

When the foot treadle switch (or alternatively switch 27) is depressed, motor 90 causes shaft 44, eccentric 48, and camming arms 54 and 56 to rotate clockwise. As camming arms 54 and 56 are rotated toward the lower rear of the machine, in the direction of the arrow, buttons 55 and 57 travel downward in slots 113 and 148 to the broken line position. As is perhaps better shown in FIG. 7, this downward movement laterally displaces cams 116 and 128. More particularly, when button 55 begins to descend down slot 113, it causes comb plate 14 to immediately begin moving toward the position shown by the dashed lines. A corresponding initial movement of button 57 in slot 148 causes no initial displacement of hooks 16. This relationship allows the initial movement of comb plate 14 to force the plastic binder fingers of comb 176 (shown in FIG. 6) beneath hooks 16 before hooks 16 begin their movement away from comb plate 14.

As buttons 55 and 67 descend further, no additional displacement of comb plate 14 is effected, but cam 128 is caused to continue moving laterally. As can be understood from FIG. 5, the lateral movement of cam 128 causes drive bar 122 to shift likewise, thereby causing the attached bell cranks 124 and 126 to pivot about attachments 145 resulting in the translation of the hook plate attached to one end of the bell cranks by bolts 131. As hooks 16 move away from comb plate 14, they spread the fingers of binder 176 as shown by the dashed lines. The binder adjustment mechanism 166 will be described in more detail below.

The punched sheets are then placed over the extended binder fingers, and motor 90 is reversed by depressing switch 162 (FIG. 4) so that camming arms 54 and 56 rotate upward causing hooks 16 to retract toward comb plate 14. As they are freed, the fingers curl upwardly intertwining the punched sheets (not shown). Comb plate 14 does not move until eccentric 48 is almost back to full upright position and hooks 16 are adjacent comb plate 14. At that point comb plate 14 shifts laterally, removing the fingers of the plastic binder from hooks 16 and allowing the bound sheets to be lifted away.

FIGS. 6 and 6A also illustrate the binder size adjustment mechanism 166 which includes the adjusting rod 20, a semicircular plate 170 which is rotatably mounted concentric with but unattached to shaft 44, and two microswitches 172 and 174 which are carried by plate 170. As adjustment rod 20 is moved upward or downward, plate 170 rotates about shaft 44 changing the position of switch 172 relative to a fixed pin 173, and changing the position of switch 174 relative to the rotational position of eccentric 48. Switch 172 is located at the top of plate 170 so as to engage and be closed by the pin 173 when the adjusting rod 20 is in its lowermost position. In this position, switch 172 causes logic module 114 to excite motor 90 in the punching mode. At all other settings of rod 20 switch 172 is open.

Switch 174 is affixed to the lower portion of plate 170 and is engaged and closed by a pin 51 carried by eccentric 48. Switch 174 serves as a limit switch which when closed causes logic module 114 to deenergize motor 90 thus limiting the travel of hooks 16 away from this starting position. Thus, the position of adjustment rod 20 determines how far hooks 16 extend the binder fingers 176 so that different size binders may be used.

Referring now additionally to FIGS. 8 and 9, when adjusting rod 20 is in the "punch mode" position and motor 90 is energized by logic module 114 in response to actuation of a foot treadle or other switch, it causes eccentric 94 to rotate. As eccentric 94 rotates through the first half of a revolution, lever 46, shaft 44, and eccentric 48 are in turn rotated as described previously, causing the pressure bar assembly 75 to force punches 88 through the sheets positioned therebeneath. As eccentric 94 rotates through the second half revolution, the direction of rotation of lever 46, eccentric 48 and shaft 44 is reversed, causing punches 88 to be withdrawn from the strips of paper. When lever 46 contacts microswitch 34 (see FIGS. 2 and 4), logic module 114 is notified that a complete revolution has been completed and motor 90 is deenergized. It should be appreciated that motor 90 can be reversed at any time by depressing switch 164 so that the apparatus is easily freed if a jam should occur during the punching operation.

When the punching operation is completed and the punched sheets are ready for binding, a plastic comb binder is placed over the teeth of comb 14 and the binder adjustment mechanism is adjusted by moving rod 20 from the punching mode setting to the appropriate binder size setting indicated on face plate 18. The opening of switch 172 as rod 20 is moved into the binding mode setting causes logic module 114 to energize solenoid 62 to cause rod 60 to move (see FIG. 2) into engagement with hole 49 in eccentric 48 thereby locking the eccentric to shaft 44. The foot treadle switch (or alternatively switch 27) is then depressed to actuate motor 90 which in turn causes camming arms 54 and 56 to rotate with shaft 44 and eccentric 48 rather than to freely pivot thereabout as when solenoid 62 is not energized. As the arms 54 and 56 rotate downwardly, they drive cams 116 and 118 laterally to respectively move comb 14 and hooks 16 as described above. Shaft 44 is rotated until eccentric 48 contacts microswitch 174 and closes it to cause motor 90 to be deenergized. The travel of hooks 16 is terminated at a point so that the binder fingers are fully extended. Thus, a particular size of binding requires a particular setting of rod 20.

The prepunched sheets are then placed over the extended binder fingers and switch 162 (FIG. 4) is depressed, causing motor 90 to rotate counterclockwise and in turn, rotate shaft 44 counterclockwise driving button 55 upwardly in cam 116. Simultaneously, frictionless button 57 is caused to move upwardly in cam 128 to laterally return it to its rest position retracting hooks 16 so as to allow the fingers of comb 176 to extend into and through the punched holes in the stack of papers to be bound. Frictionless button 55 on arm 54 will, near the end of its movement, also cause comb 14 to return to its rest position. As both comb 14 and hooks 16 are moved into their rest positions, actuating arm 46 will contact switch 77 causing it to close and deenergize motor 90. At this point the binding operation is complete, and the bound sheets may be removed from the top of the machine.

FIG. 8 is a generalized block diagram showing the principal electrical components used in the present invention. The seven switches 27, 34, 77, 162, 164, 172 and 174, plus the foot treadle previously referred to, provided the necessary control inputs for the electronic logic module 114 which in response develops control signals for controlling motor 90 and solenoid 62. In the preferred embodiment the eight above-mentioned switches are for convenience merely simple microswitch devices. However, any other suitable component position sensing mechanism or device could be used. The electronic logic circuit module 114 shown in detailed schematic in FIG. 9 is designed to respond to the opening and closing of the several switches and to actuate solenoid 62 and motor 90 in the manner described and illustrated in the diagram of FIG. 10. Operation of the circuit 114 is believed to be ascertainable from the schematic of FIG. 9 and thus no lengthy detailed description is deemed necessary.

Referring now to FIG. 10, two timing diagrams are provided which illustrate the interaction of the various switches during the punching and binding modes of operation. The bars indicate switch closed, solenoid actuated, and motor energized conditions. As shown in the punch mode portion of the diagram, switch 27 (or its alternative) controls the punching operation. Initially, with punches 88 in the upper position, lever arm 46 will be in contact with and be holding switch 34 in the closed configuration. When the stack of papers are inserted into slot 25 and switch 27 is contacted (or the foot treadle switch is depressed) motor 90 will be energized and cause lever arm 46 to move away from and open switch 34. Motor 90 remains energized, cycling through an entire revolution, until switch 34 is again contacted by arm 46 which indicates completion of the punching cycle and the logic circuits cause motor 90 to be deenergized.

When the present invention is operated in the binding mode, switches 27, 77, 162, 164, 174 and the alternative foot treadle switch control the operation. More particularly, once the plastic binder is properly positioned on the comb 14 and adjustment rod 20 is set in the position corresponding to the size of the binder used, binder extender switch 162 may be depressed to actuate motor 90. Remember that movement of rod 20 into a binding setting opens switch 172 and actuates solenoid 62 causing it to lock eccentric 48 to shaft 44. Motor 90 will then cause comb 14 to move laterally, and thereafter cause hooks 16 to move away from comb 14 until switch 174 is closed by the pin 51 or eccentric 48.

Binder retractor switch 162 is then either continuously or intermittantly actuated (manually) causing motor 90 to reverse direction and return hooks 16 toward comb 14, and to move comb 14 laterally to its starting position. When lever arm 46 closes switch 77, switch 162 will be rendered inactive.

The present invention provides full control of the punches through use of the previously described three-toothed gears and three-toothed racks and the so-called possilock feature which was described in the above-mentioned copending application; the latter consisting of an enlarged gear tooth which moves into position beneath the lower rack tooth to keep the pressure bar from dropping when the gear is disengaged from the rack during the binding operation. The push-button unjamming feature of the present invention is also of substantial benefit and involves the selective reversing of the punch driving motor 90 using switch 164.

Another important feature of the present invention is that through the use of switch 164 an over-ride of the incremental setting of the position of the binding hooks can be achieved. In other words, when necessary, switch 164 can be used to open the bindings a little wider or if a large book is being bound and perhaps a couple of sheets have been missed, the binding operation can be reversed by using switch 164 to open the hooks back up. Switch 162 can then be used to again close the hooks to finish the binding. As a result of this selective hook closing feature, the operator does not have to close the hooks and index the comb back every time, but can incrementally close the hooks a little at a time, and if necessary, even open them back up a little bit a mentioned above.

A still further feature of the present invention is that achieved by utilizing the reverse direction of motor 90 in the binding operation. An advantage of slower movement of the binding is achieved due to the position of roller 98 in slot 47 of lever 46 at the start of the binding opening. Remembering that the motor is running in the reverse or counterclockwise direction when binding is being effected, it will be noted that a relatively small movement of lever 46 is required due to the fact that roller 98 is at the top of its cycle when it starts and lever 46 is raised at the rear to its highest point.

And finally, the motor brake which locks the hooks and pressure bar in whatever position they are when the motor is stopped, is an important feature. For example, during the binding operation the plastic binding is trying very hard to pull the hooks back to the starting or closed position and the solenoid brake on the motor prevents this from happening. With regard to the pressure bar used to effect the punching operation, even through the bar will always stop at the very top of the stroke, it could be expected to drift a little more into the start of the down stroke thereby leaving the longest punches interferring with the paper. The braking feature of the present invention prevents this.

It is contemplated that after reading the above disclosure of the preferred embodiments, many additional alterations and modifications of the present invention will no doubt become apparent to those of ordinary skill in the art. Accordingly, it is to be understood that such disclosure is made for illustration only and is not to be considered limiting. Moreover, it is intended that the appended claims be interpreted as covering all such alterations and modifications as fall within the true spirit and scope of the invention.

What is claimed is:

1. Punching and binding apparatus, comprising:
- means forming a base;
- punching means for punching apertures along an edge of a stack of sheet material;
- binding means for inserting the flexible fingers of a comb binder through the punch apertures for binding the sheet material together and including,
  - an elongated rigid comb plate member having a plurality of comb teeth,
  - an elongated rigid hook plate having a plurality of hooks corresponding in number to the number of said comb teeth, and
  - guide means to which said comb plate and said hook plate are mounted, said guide means permitting said comb plate to move in its longitudinal direction between a first position and a second position, said hook plate being mounted adjacent said comb means with its hooks being positioned proximate said comb plate and being movable away from said comb plate, and
- actuating means for actuating said punching means and said binding means including,
  - an actuating shaft, an electric motor affixed to said base and first means mechanically coupling the armature of said motor to said shaft to impart rotary energy thereto, second means mechanically coupling said shaft to said punching means;

a first camming means affixed to said hook plate and including a second camming surface, a first arm carried by and extending radially from said shaft to cammingly engage said first camming surface and move said comb plate, a second arm carried by and extending radially from said shaft to cammingly engage said second camming surface and move said hook plate, function selector means having a punch setting and bind setting, coupling means responsive to said selector means and operative to selectively couple said first and second arms to said shaft when said coupling means is in said bind setting, and an electronic control module responsive to said selector means and operative to energize said motor, whereby when said selector means is in said punch setting, said motor is caused to actuate said punching means and when said selector means is in said bind setting, said coupling means and motor cause said first arm to move said first camming means which in turn moves said comb plate between said first position and said second position, and further cause said second arm to move said second camming means which in turn moves said hook plate away from and back toward said comb plate.

2. Punching and binding apparatus as recited in claim 1 wherein said selector means can be incrementally varied in said second setting to determine the distance said hook plate is moved away from said comb plate.

3. Punching and binding apparatus as recited in claim 1 wherein said coupling means includes a solenoid and a locking pin driven thereby, said locking pin being operative to lock said first and second arms relative to said shaft.

4. Punching and binding apparatus as recited in claim 3 wherein said first and second camming means include elongated members having upper ends affixed to said comb plate and said hook plate, respectively, and lower ends adapted to slideably engage said base.

5. Punching and binding apparatus as recited in claim 1 and further comprising a first electrical switch means which is actuated in response to rotation of said shaft to a limit in one direction, and a second electrical switch means which is actuated in response to rotation of said shaft in a second direction, said switches being included in logic circuitry forming said control module.

6. Punching and binding apparatus as recited in claim 5 wherein said function selector means includes a plate carried by said shaft and rotatable between a first position and a second position, a third electrical switch means and a fourth electrical switch means mounted to said plate, said third switch means being actuated when said plate is in said first position, and said fourth switch means being actuated by rotation of said shaft into a predetermined position relative to said plate, said third and fourth switch means being included in logic circuitry forming said control module.

7. Punching and binding apparatus as recited in claim 1 wherein said motor includes electrically responsive braking means for locking the armature thereof in a fixed position when no driving energy is applied to said motor.

8. Punching and binding apparatus as recited in claim 1 wherein said first means mechanically coupling said armature to said shaft includes an eccentric driven by said armature, and an elongated lever arm having one end attached to said shaft and its other end connected to said eccentric wherein rotation of said armature causes said eccentric to move said lever arm to in turn cause said shaft to rotate.

9. Punching and binding apparatus as recited in claim 1 wherein said punching means includes punch elements and die elements, and said first means includes rack gears affixed to said punch elements and mating pinion gears affixed to said shaft, whereby rotation of said shaft during at least a portion of its rotational motion causes said punch elements to punchingly mate with said die elements.

10. Punching and binding apparatus as recited in claim 9 wherein one tooth of said pinion gears is broader than the remaining teeth and engaging the lower tooth of said rack gears so as to hold said punch elements in a fixed position during a portion of the rotational motion of said shaft thereby enabling full control of said punch elements through the full punching stroke.

11. Punching and binding apparatus as recited in claim 1 and further comprising first switch means which when closed causes said control module to cause said motor to drive said shaft in a first direction.

12. Punching and binding apparatus as recited in claim 11 and further comprising second switch means which when closed causes said control module to cause said motor to drive said shaft in a second direction.

13. Punching and binding apparatus as recited in claim 1 wherein said selector means includes means for enabling incremental positioning of said hooks during the binding operation.

14. Punching and binding apparatus as recited in claim 13 and further comprising switch means for enabling said control module to override the hook positioning effected by said selector means.

* * * * *